United States Patent [19]

Kovacs

[11] 4,346,632

[45] Aug. 31, 1982

[54] ADJUSTABLE SOCKET WRENCH

[76] Inventor: Julius Kovacs, 32 Cedar La., Trumbull, Conn. 06611

[21] Appl. No.: 187,409

[22] Filed: Sep. 15, 1980

[51] Int. Cl.[3] ..... B25B 13/16
[52] U.S. Cl. ..... 81/174
[58] Field of Search ..... 81/155, 164, 165, 173, 81/174, 180 C, 129

[56] References Cited

U.S. PATENT DOCUMENTS

| | | | |
|---|---|---|---|
| 841,986 | 1/1907 | Lacheze | 81/164 |
| 1,325,380 | 12/1919 | Seitzman | 81/174 |
| 1,744,197 | 1/1930 | Anderson | 81/129 X |

FOREIGN PATENT DOCUMENTS

| | | | |
|---|---|---|---|
| 21965 | 4/1883 | Fed. Rep. of Germany | 81/164 |
| 1466 | of 1891 | United Kingdom | 81/174 |

*Primary Examiner*—James G. Smith
*Attorney, Agent, or Firm*—Arthur T. Fattibene

[57] ABSTRACT

An adjustable socket wrench having a split socket formed of a pair of complementary jaw members which can be readily adjusted relative to one another for rendering a single wrench adjustable to a relatively large number of differently sized nuts and/or bolts coming within a given range of sizes and which socket includes a reinforcing member to resist the turning or twisting moment imparted to the split socket when the socket is subjected to a torque or turning stress.

6 Claims, 9 Drawing Figures

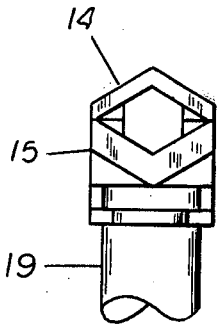
FIG. 2
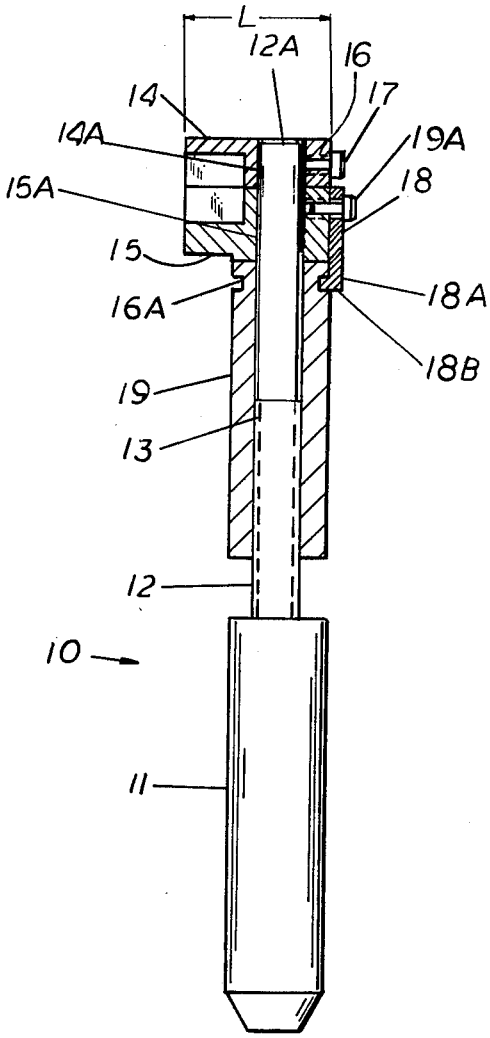
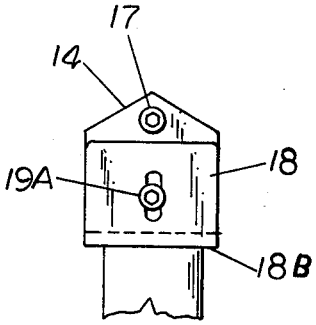
FIG 2A
FIG 1

FIG. 4
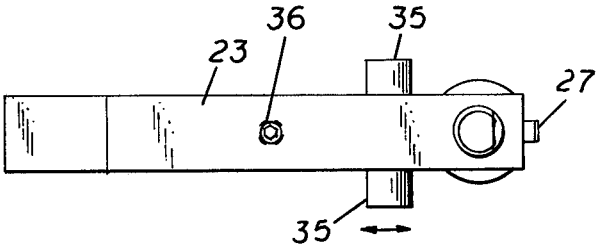
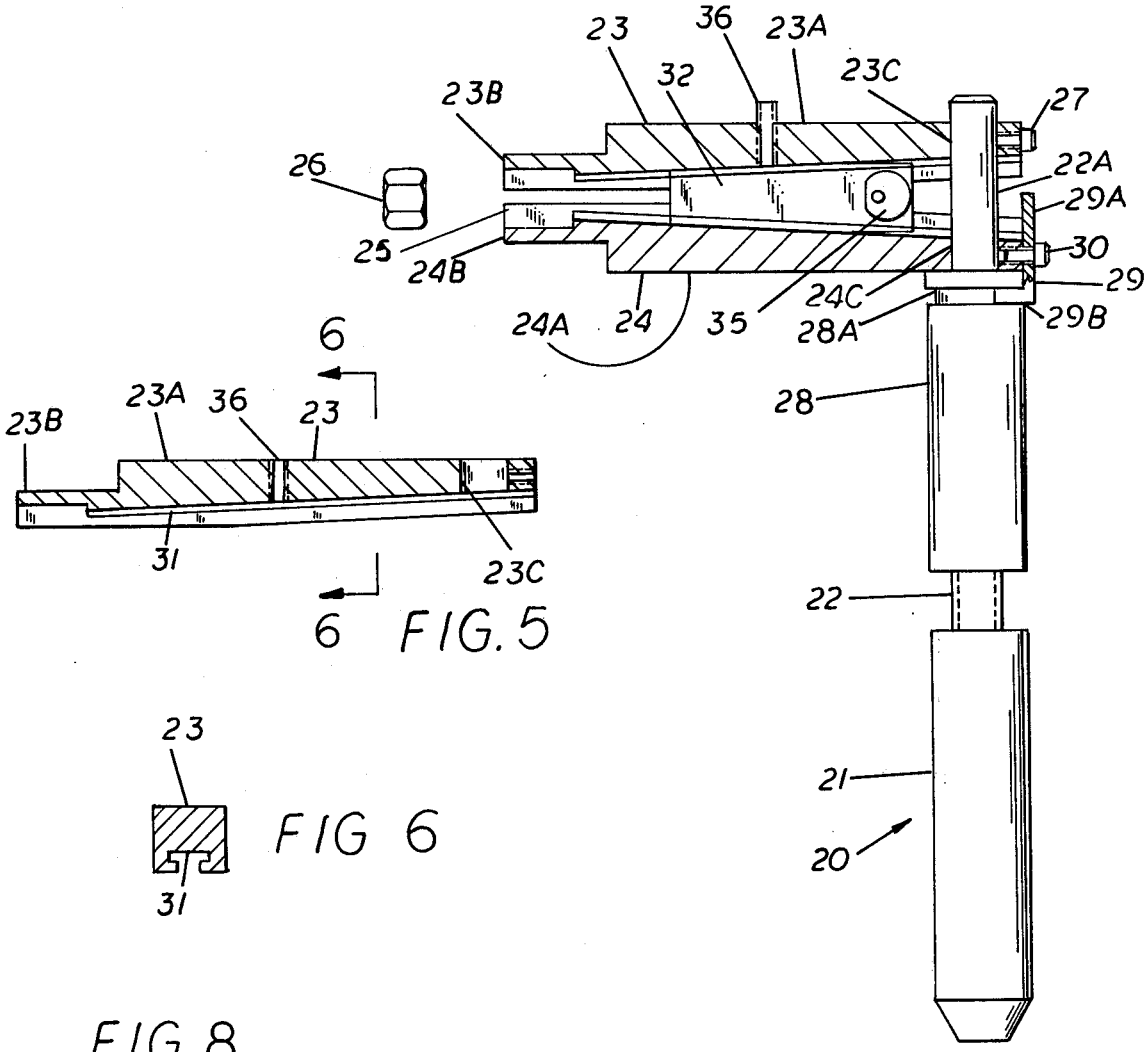
FIG. 3
FIG. 5
FIG 6
FIG 8
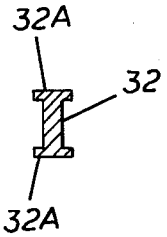
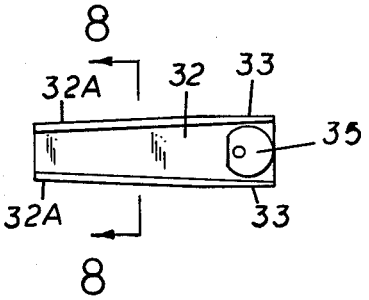
FIG 7

ADJUSTABLE SOCKET WRENCH

PROBLEM AND PRIOR ART

Heretofore, socket wrenches have been known which have been constructed to fit only a specific or given size of nut or bolt. For this reason, such socket wrenches have been made and sold generally in sets wherein each set includes a plurality of wrenches, each being of a different size to fit a specific size workpiece. As a result, such wrenches were sized according to either the English system or the metric sizes. As the current trend is toward the adoption of the metric sizes, it is incumbant upon a mechanic to have on hand numerous wrenches sized in both the English and Metric dimensions. Maintaining an inventory of the various sizes of socket wrenches for both the English and Metric sizes can be a costly and expensive proposition. In the event a specific wrench is lost or misplaced, a considerable difficulty is encountered when a specific sized wrench is not available for a particular application. To obviate this problem, efforts have been made to provide an adjustable type socket wrench which can be adjusted to any of several different sizes within a range of sizes. Such adjustable socket wrenches as evidenced by U.S. Pat. Nos. 10,145; 445,356, 3,311,002, 3,847,092 and others comprised structures having split socket members which could be spread to fit various sized nuts or bolts. However, a particular problem noted with the known adjustable socket wrench is that under stress the torque moment imparted to the split socket causes the split socket members to twist or turn thus limiting the size of such adjustable wrench to an application requiring only a little or slight turning moment.

OBJECTS

An object of this invention is to provide an improved adjustable socket wrench which is sturdy in construction, simple to fabricate and is positive in operation.

Another object is to provide an improved adjustable socket wrench which can be subjected to a considerable amount of torque or turning moment without twisting.

Another object is to provide an improved socket head construction for use as an adjustable socket wrench.

SUMMARY OF THE INVENTION

The foregoing objects and other features and advantages are attained by a socket wrench which includes a handle having a shank which has mounted thereon a pair of complementary jaw members arranged for movement relative to one another for adjusting the jaw opening to a specific sized workpiece, such as a nut or bolt. An adjusting sleeve is connected to one of the jaw members whereby the connected member can be readily moved toward or away from the other jaw member to define a particular jaw opening. In one form of the invention, when an elongated jaw member is required for a particular application, a reinforcing member or wedge is slidably disposed between the jaw members which is arranged to resist any twisting moment imparted to the jaw members when the jaws are subjected to a large turning or torque moment.

FEATURES

A feature of this invention resides in the provision of an adjustable socket wrench having an improved adjustable jaw construction which are capable of resisting large turning forces.

Another feature resides in the provision of an adjustable socket wrench which includes a pair of complementary jaw members which can be readily adjusted relative to one another in a simple and expedient manner.

Other features and advantages will become more readily apparent when considered in view of the drawings in which:

FIG. 1 is a side elevation view of an adjustable socket wrench embodying the invention having parts shown in section.

FIG. 2 is a plan or bottom view of FIG. 1.

FIG. 2A is a top view of FIG. 1.

FIG. 3 is a side elevation view of a modified embodiment; having parts shown in section.

FIG. 4 is a left end view of 3.

FIG. 5 is a detail section view of the jaw member of the embodiment of FIG. 3.

FIG. 6 is a detail section view taken on line 6—6 on FIG. 5.

FIG. 7 is a detail side view of the reinforcing wedge.

FIG. 8 is a section view taken along line 8—8 on FIG. 7.

DETAILED DESCRIPTION

Referring to the drawings, there is shown in FIG. 1 and 2 an embodiment of the present invention. As shown, the socket wrench 10 of FIGS. 1 and 2 includes a suitable handle 11 having a connected shank 12. A portion of the shank 12 is provided over an intermediate length thereof with externally formed threads as at 13.

The extreme end 12A of the shank 12 is provided with a flattened portion which is adapted to be keyed to the socket jaws 14 and 15 as will be hereinafter described.

As shown, the socket portion of the tool or wrench 10, is defined by a pair of complementary jaws or jaw members 14 and 15 which are shaped to complement the shape of a workpiece, e.g. a nut or bolt. In the illustrated embodiment each jaw member 14 and 15 is provided with a bore 14A and 15A respectively through which the extended end 12A of the shank extends. As shown one of the jaws, e.g. jaw 14 is provided with a tapped hole 16 for receiving a set pin or screw 17 whereby the jaw 14 can be fixedly secured to the shank 12A. The other jaw 15 is slidably mounted on the end 12A of the shank 12 for movement toward and away from the fixed jaw 14.

The movement of the jaw 15 relative to jaw 14 is effected by an adjusting sleeve 19 which is threaded onto the threaded portion 13 of the shank for relative longitudinal movement therealong. A coupling or connector 18 connects the movable jaw to the adjusting sleeve 19. In the illustrated form the connector 18 comprises a plate portion 18A having a depending flange portion 18B which is adapted to be received in an annular groove 16A circumscribing the adjacent end of the adjusting sleeve 19. It will be apparent that as the adjusting sleeve is rotated in one direction or the other, the sleeve 19 and the movable jaw 15 coupled thereto is shifted toward and away from the fixed jaw. Thus, by adjusting the jaw opening defined by the complementary jaw members 14 and 15, the socket defined whereby can be adjusted to complement any workpiece size falling with the minimum and maximum jaw openings of a given wrench. The connector 18 is secured to the movable jaw 15 by a set screw or fastener 19A.

It will be understood that the length "L" of the respective jaws can vary. For lengths "L" which are relatively long or deep as shown in the form of the invention illustrated by FIG. 3 and 4, a means is provided to prevent the twisting of the jaw members when the wrench is stressed under a large turning or torque force.

Referring to FIGS. 3 to 8 the modified wrench construction 20 comprises a handle 21 and shank 22 similar to that described with respect to FIGS. 1 and 2. In this form of the invention the jaw members 23 and 24 are made substantially long so as to enable the socket opening 25 defined thereby to reach areas which would be otherwise unaccessible. In the illustrated embodiment each jaw member is provided with a relatively long mounting or head portion 23A, 24A and a connected nose or jaw portion 23B, 24B. It will be understood that the respective jaw portions 23B, 24B are shaped or formed to complement a nut or bolt or other workpiece 26.

The respective jaw members are each provided with a bore 23C, 24C, for receiving the end 22A of shank 22. The end 22A may be provided with a flat as hereinbefore described so as to maintain the respective jaw members 23, 24 orientated relative to its shank 22. As shown, jaw member 23 is fixedly secured to the ends of the shank 22 by a set screw or fastener 27. The other jaw member 24 is longitudinally slidable along shank 22.

As hereinbefore described the movable jaw member 24 is coupled to the adjusting sleeve 28 by a connector 29. The connector includes a plate portion 29A secured to the movable jaw by a screw or fastener 30. The plate portion 29A is provided with an end flange 29B which engages an annular groove 28A of the adjusting sleeve 28. Thus, as the adjusting sleeve is shifted longitudinally of the shank, the movable jaw member 24 is displaced toward and away from the fixed jaw member 23, accordingly.

In this form of the invention each jaw member is provided with a slideway 31 which extends longitudinally along the elongated head portion 23A, 24A respectively. As best seen in FIG. 6 the slideway is formed with a "T" shaped cross section. Also, as shown on FIG. 5, the slideway 31 is inclined upwardly and outwardly relative to its respective jaw member.

Slidably disposed between the respective jaw member 23, 24 and arranged to slide in the respective slideways in a wedge shaped member 32 as best shown in FIGS. 6 and 7. The wedge shaped member 25 is generally I shaped in cross section as seen in FIG. 8, with the end portions 32A arranged to be received in the opposed slideways 31 of jaw members 23, 24. In the illustrated embodiment the sides of the wedge adjacent to the upper end are flattened and parallel as at 33 and which sides then taper inwardly and downwardly as shown. Connected to the wedge on opposed sides thereof is a slider 35. If desired a lock or set screw 36 is provided to lock the wedge 32 in an adjusted position between jaw members 23, 24.

In operation, the setting of the jaw members to a particularly sized workpiece 26 is effected by loosening the set screw 36 and then rotating the adjusting sleeve 28 in one direction or the other to adjust the size of the socket opening 25. With the construction described, the arrangement is such that the wedge is moved progressively upwardly as the socket opening 25 is progressively decreased, and the wedge is moved progressively downward between the jaws 23, 24 as the jaws are progressively opened. When the desired jaw opening 25 is achieved, the wedge is locked in place by tightening the set screw 36.

With the construction described, it will be noted that as the jaw opening 25 is enlarged, which will increase the twisting movement imparted to the respective jaw members when a torque force is applied, that the wedge 32 is lowered thereby imparting a restraining mass or force at the lower end of the jaw members which will function to resist the twisting movement which would otherwise be imparted to the jaw members. As the jaw opening is reduced in size thereby causing the jaw members to be moved closer together, the wedge is displaced upwardly. The sliders 35 connected to the wedge 32 facilitates the shifting of the wedge upwardly or downwardly accordingly as the jaw members are adjusted between its minimum and maximum opening. As shown in FIG. 4, the sliders are disposed in sliding relationship to the side edges of the respective jaw members.

While the present invention has been described with respect to several embodiments thereof, it will be appreciated and understood that variations and modifications may be made without departing from the spirit or scope of the invention.

What is claimed is:

1. An adjustable socket wrench comprising a handle means and a connected shank, a pair of socket jaws, means for fixably connecting one of said jaws to said shank and means for movably mounting the other jaw on said shank, and means for adjusting said movable jaw relative to said fixed jaw, and including a means disposed between said jaws to resist a turning moment when a torque force is applied to said wrench, wherein said last mentioned means comprises a wedge disposed between said jaws, and means for rendering said wedge slightably adjustable relative to said jaws as said jaws are moved to an adjusted position.

2. An adjustable socket wrench comprising a handle having an extended shank, said shank having a threaded position, a pair of jaw members mounted on said shank, each of said jaw member having an elongated mounting portion and a connected jaw portion, the mounting portion of each jaw member having an elongated slideway formed therein, said slideway being inclined relative to the axis of said shank a wedge slidably disposed in and between said slideways, means for fixedly securing one of said jaw members to said shank, and means for slidably mounting said other jaw member on said shank, an adjusting sleeve threaded on said threaded portion of said shank, and a connecting means for connecting said movable jaw member to said adjusting sleeve whereby said movable jaw member is rendered adjustable relative to said fixed jaw member as said sleeve is longitudinally adjusted relative to said shank.

3. An adjustable socket wrench as defined in claim 2 and including means for fixedly securing said wedge in the adjustable position.

4. An adjustable socket comprising a pair of complementary jaw members each of said jaw members having an elongated head portion and a connected jaw portion, each of said connected jaw portions being shaped to adapt said socket to the shape of a workpiece, means defining an elongated slideway formed in elongated head portion of each said jaw members, said slideways being inclined transversely of its respective jaw member, a wedge slidably disposed between said jaw members in said slideways whereby the displacement of said wedge between said jaw members effects the displacement of said jaw members toward and away relative to one another.

5. An adjustable socket as defined in claim 4 and including means for securing said wedge in the adjusted position between said jaw members.

6. An adjustable socket as defined in claim 5 wherein each of said slideways is T shaped in cross section, and said wedge is I shaped in cross-section, whereby the ends of said I shaped wedges are slidably received within the T shaped slideways of the respective jaw members.

* * * * *